US006981627B2

(12) United States Patent
Tsai

(10) Patent No.: US 6,981,627 B2
(45) Date of Patent: Jan. 3, 2006

(54) ELECTRIC STAPLER HAVING AN APPARATUS TO BEND STAPLE LEGS AND THE APPARATUS

(75) Inventor: Cheng-Tao Tsai, Tali (TW)

(73) Assignee: Apex Mfg. Co., Ltd., Tali (TW)

( * ) Notice: Subject to any disclaimer, the term of this patent is extended or adjusted under 35 U.S.C. 154(b) by 0 days.

(21) Appl. No.: 10/830,389

(22) Filed: Apr. 21, 2004

(65) Prior Publication Data

US 2005/0236458 A1 Oct. 27, 2005

(51) Int. Cl.
*B25C 7/00* (2006.01)

(52) U.S. Cl. ..... 227/155; 227/154; 227/82

(58) Field of Classification Search ..... 227/131, 227/154, 155, 82
See application file for complete search history.

(56) References Cited

U.S. PATENT DOCUMENTS 4,449,661 A * 5/1984 Spehrley, Jr. ..... 227/155
4,593,847 A * 6/1986 Hagemann ..... 227/155
4,664,305 A * 5/1987 Blake et al. ..... 227/19
5,516,025 A * 5/1996 Eriksson ..... 227/155
5,645,567 A * 7/1997 Crainich ..... 606/219
6,036,074 A * 3/2000 Manabe ..... 227/155
6,698,640 B2 * 3/2004 Hakozaki et al. ..... 227/4
6,820,790 B2 * 11/2004 Ura ..... 227/131
2003/0111506 A1 * 6/2003 Kanai et al. ..... 227/131

* cited by examiner

*Primary Examiner*—Scott A. Smith
*Assistant Examiner*—Gloria R. Weeks
(74) *Attorney, Agent, or Firm*—Dellett & Walters

(57) ABSTRACT

An electric stapler includes a clinching mechanism and an anvil device. The clinching mechanism bends protruding legs of a staple to fasten objects together. The anvil device includes a stationary frame, a cover and a sliding anvil mechanism. The cover is mounted on the stationary frame and has a through hole through which the legs of the driven staple protrude. The sliding anvil mechanism is mounted in the stationary frame and includes a first and a second anvil device. Each of the anvil devices includes a sliding anvil. The sliding anvils are driven toward the through hole to bend respectively the legs in the through hole. Consequently, the sliding anvils completely bend the legs protruded from the bottom of the objects to keep a person handling the stapled object from potential injury.

14 Claims, 6 Drawing Sheets

ELECTRIC STAPLER HAVING AN APPARATUS TO BEND STAPLE LEGS AND THE APPARATUS

BACKGROUND OF THE INVENTION

1. Field of the Invention

The present invention relates to an electric stapler, and more particularly to an electric stapler having an apparatus that will completely bend the legs of staples to staple an object such as pieces of paper or the like.

2. Description of Related Art

Electric staplers conveniently fasten pieces of paper or the like together. A conventional stapler uses a conventional clinching mechanism to drive staples into objects, such as pieces of paper. The staples are typically U-shaped and have two pointed legs that penetrate the pieces of paper, extend out of the pieces of paper and are bent to hold the pieces of paper together.

The conventional clinching mechanism comprises a drive element and a stationary anvil. The drive element drives a staple out of a staple magazine in the stapler so that the pointed legs will penetrate and extend out of the object and press against the stationary anvil. The stationary anvil is positioned under the drive element and has two concave recesses. The concave recesses are positioned respectively in the path of the extended pointed legs of the staple to bend the legs of the staple. The extended legs pass respectively into the concave recesses and bend along the concave recesses to fasten the object.

When the object is too thin, the bent legs may bend back completely and protrude back through the object. The legs protruding from the object constitute a hazard to people handling the stapled object.

When a stack of objects is too thick, the legs may not protrude sufficiently through the stack of objects to be completely bent by the concave recesses. The incompletely bent legs constitute a hazard to people handling the stapled paper stack.

To overcome the shortcomings, the present invention provides an electric stapler having an apparatus to completely bend the legs of staples to mitigate or obviate the aforementioned problems.

SUMMARY OF THE INVENTION

The main objective of the invention is to provide an electric stapler having an apparatus that will completely bend the legs of staples to fasten pieces of paper or the like together to keep a person holding the stapled paper from potential injury.

The electric stapler in accordance with the present invention includes a clinching mechanism and an anvil device. The clinching mechanism has a driving mechanism to drive a staple with two legs to fasten objects together. The anvil device bends the legs of a driven staple and includes a stationary frame, a cover and a sliding anvil mechanism. The cover is mounted on the stationary frame and has a through hole for receiving the legs of the driven staple. The sliding anvil mechanism is mounted in the stationary frame and includes a first anvil device and a second anvil device. Each of the first and the second anvil devices includes a sliding anvil. Each of the sliding anvils is driven toward the through hole to bend a corresponding leg in the through hole. Consequently, the sliding anvils will completely bend the protruding legs at the bottom of a stack of objects to keep a person handling the stapled object from potential injury.

Other objectives, advantages and novel features of the invention will become more apparent from the following detailed description when taken in conjunction with the accompanying drawings.

DETAILED DESCRIPTION OF PREFERRED EMBODIMENT

Figure 1:
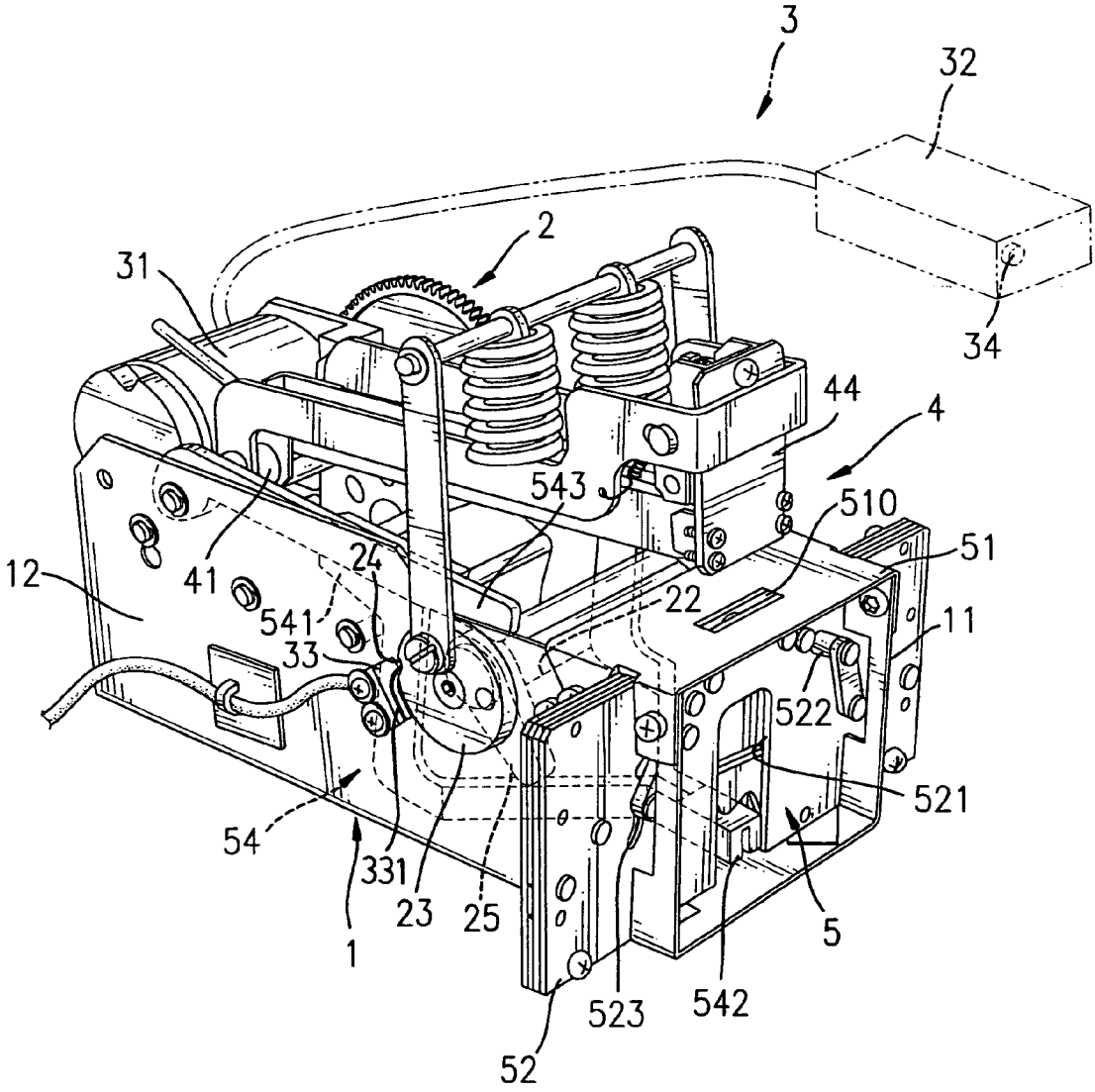
FIG. 1 is a perspective view of an electric stapler in accordance with the present invention.

With reference to FIG. 1, an electric stapler in accordance with the present invention comprises a frame (1), a transmission device (2), an actuating device (3), a clinching mechanism (4) and an anvil device (5).

The frame (1) comprises a first wing (11) and a second wing (12). The first and the second wings (11, 12) are parallel to each other.

Figure 2:
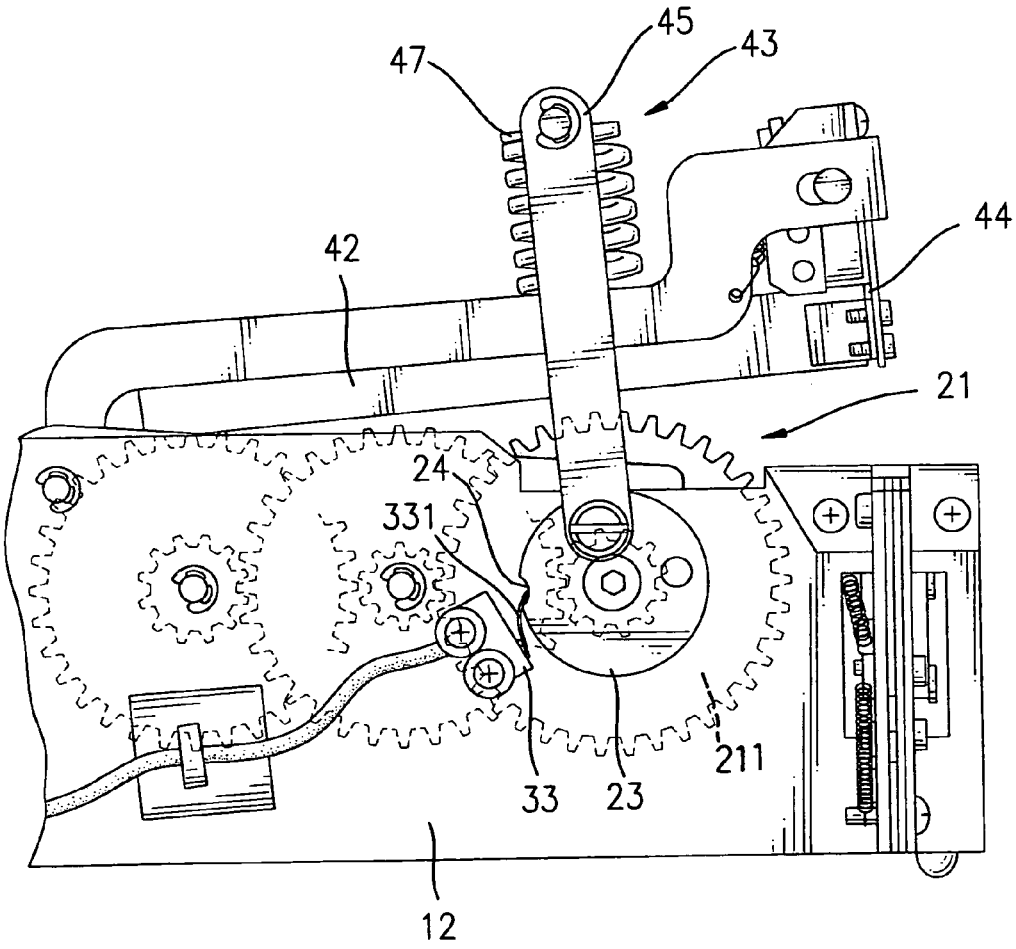
FIG. 2 is a side plan view of a segment of the electric stapler in FIG. 1.

With further reference to FIG. 2, the transmission device (2) is mounted on the frame (1) and comprises a reducer (21), a rotating shaft (22), a driven wheel (23) and a lifter such as two rotating arms (25) or cams (not shown). The reducer (21) is mounted on the first wing (11) and comprises multiple reduction gears (not numbered) that mesh to one another. The reduction gears comprise a drive gear (211). The drive gear (211) rotates the rotating shaft (22).

The rotating shaft (22) is rotatably mounted on the first and the second wings (11, 12) with its two ends extending respectively out of the first and the second wings (11, 12). The drive gear (211) and the driven wheel (23) are attached respectively to the ends of the rotating shaft (22). The driven wheel (23) is rotated by the rotating shaft (22) and has a circular edge and a detent (24). The detent (24) is defined in the circular edge.

The rotating arms (25) are mounted on the rotating shaft (22) between the first and the second wings (11, 12). The rotating shaft (22) rotates the rotating arms (25).

Figure 3:
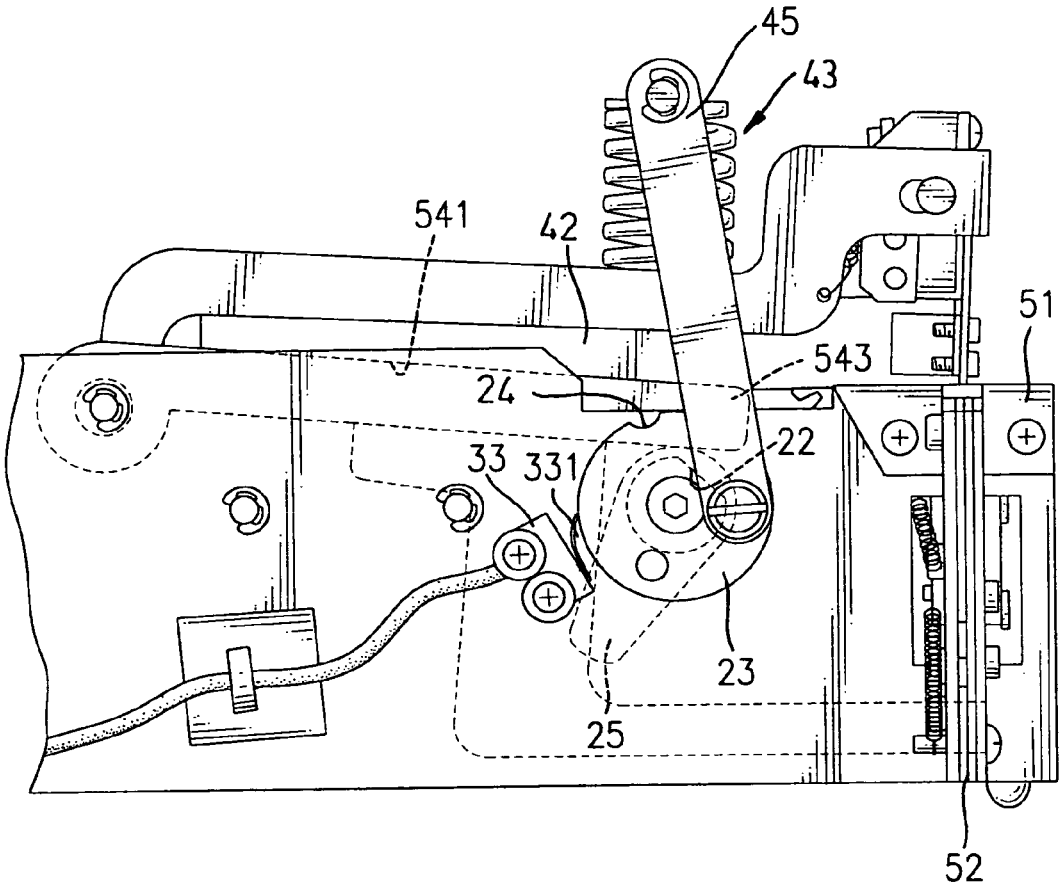
FIG. 3 is an operational side plan view of the electric stapler in FIG. 2 when a clinching mechanism drives and bends a staple.

With further reference to FIG. 3, the actuating device (3) connects to the reducer (21) and comprises an actuator (31), an actuator controller (32) and a switch (33). The actuator (31) can be an electric motor, is mounted on the first wing (11) and connects to one of the reduction gears of the reducer (21). Therefore, the reducer (21) will reduce the output speed of the motor and rotate the rotating shaft (22) at desired speeds.

The actuator controller (32) starts or stops the actuator (31) and has a trigger (34). A person starts the actuator (31) by pressing the trigger (34), and the actuator controller (32) starts the actuator (31). The switch (33) is mounted on the second wing (12) and is electrically connected to the actuator controller (32). The switch (33) has a curved lever (331). The lever (331) abuts the edge of the driven wheel (23) and stops the actuator (31) when the lever (331) is in the detent (24). When the trigger (34) is pressed, the actuator (31) starts and causes the lever (331) to slip out of the detent (24), causes the driven wheel (23) to continue to rotate. When the lever (331) slides into the detent (24) again, the switch (33) turns off and stops the actuator (3 1) as the trigger (34) is released. Therefore, the rotating shaft (22) complete only one revolution each time the trigger (34) is pressed.

The clinching mechanism (4) is mounted on the frame (1) between the first and the second wings (11, 12) and comprises a rear shaft (41), a staple magazine (42) and a biasing device (43). The rear shaft (41) is mounted on the first and the second wings (11, 12).

Figure 4:
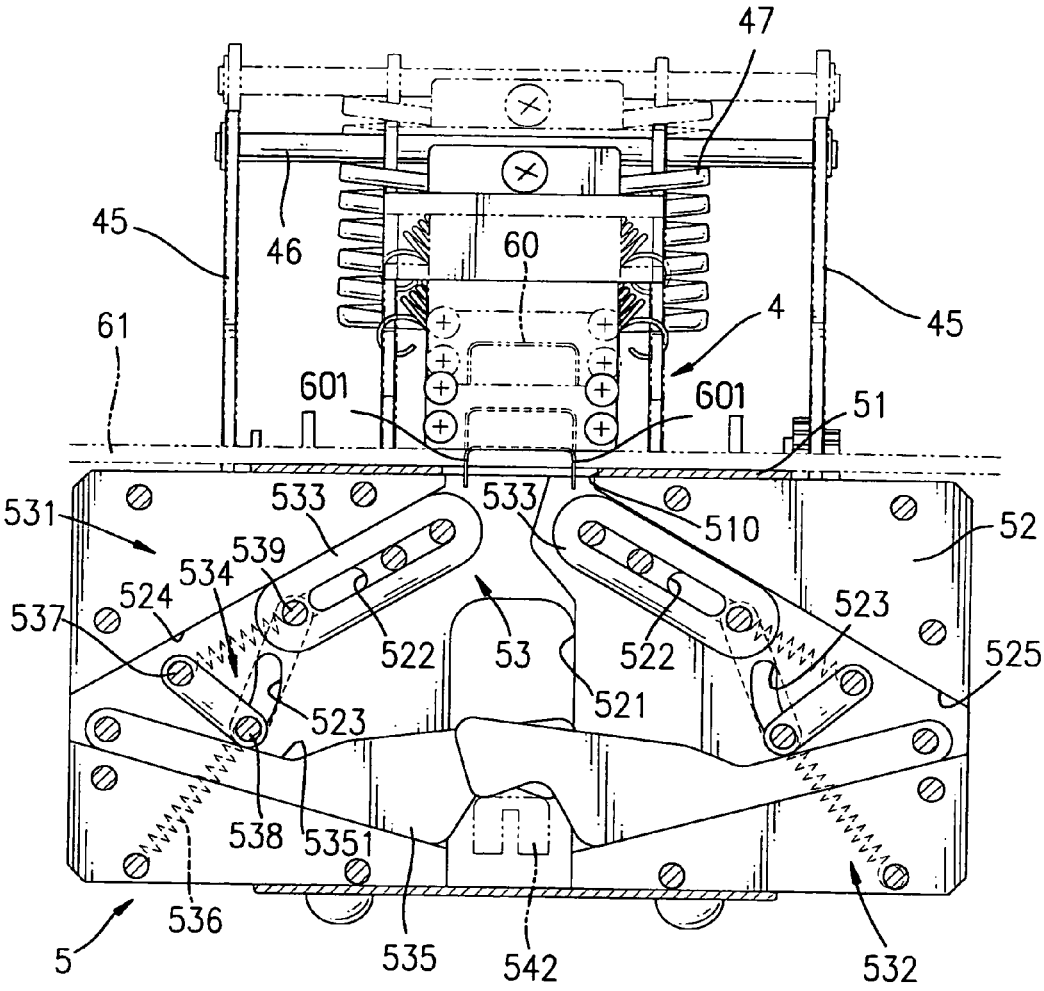
FIG. 4 is an operational front plan view in partial section of the electric stapler in FIG. 1.

With further reference to FIG. 4, the staple magazine (42) is pivotally mounted on the rear shaft (41), holds multiple staples (60) and comprises a driving mechanism (44). The driving mechanism (44) drives one staple (60) out of the staple magazine (42) through an object (61), such as a stack of paper. The staples (60) are generally U-shaped and have respectively two legs (601) that will penetrate the object (61).

The biasing device (43) comprises two connecting arms (45), a transverse rod (46) and a restitution device (47). The connecting arms (45) connect respectively to the drive gear (211) and the driven wheel (23) and respectively have a top end (not numbered) and a bottom end (not numbered). The bottom ends are eccentrically connected to the drive gear (211) and the driven wheel (23). The transverse rod (46) is connected to the top ends of the connecting arms (45). The restitution device (47) may be two springs (not numbered) and is mounted between the transverse rod (46) and the staple magazine (42).

The driving mechanism (44) will drive one staple (60) out of the staple magazine (42) as the rotating shaft (22) completes a revolution, and the restitution device (47) returns the staple magazine (42) to its original position.

Figure 5:
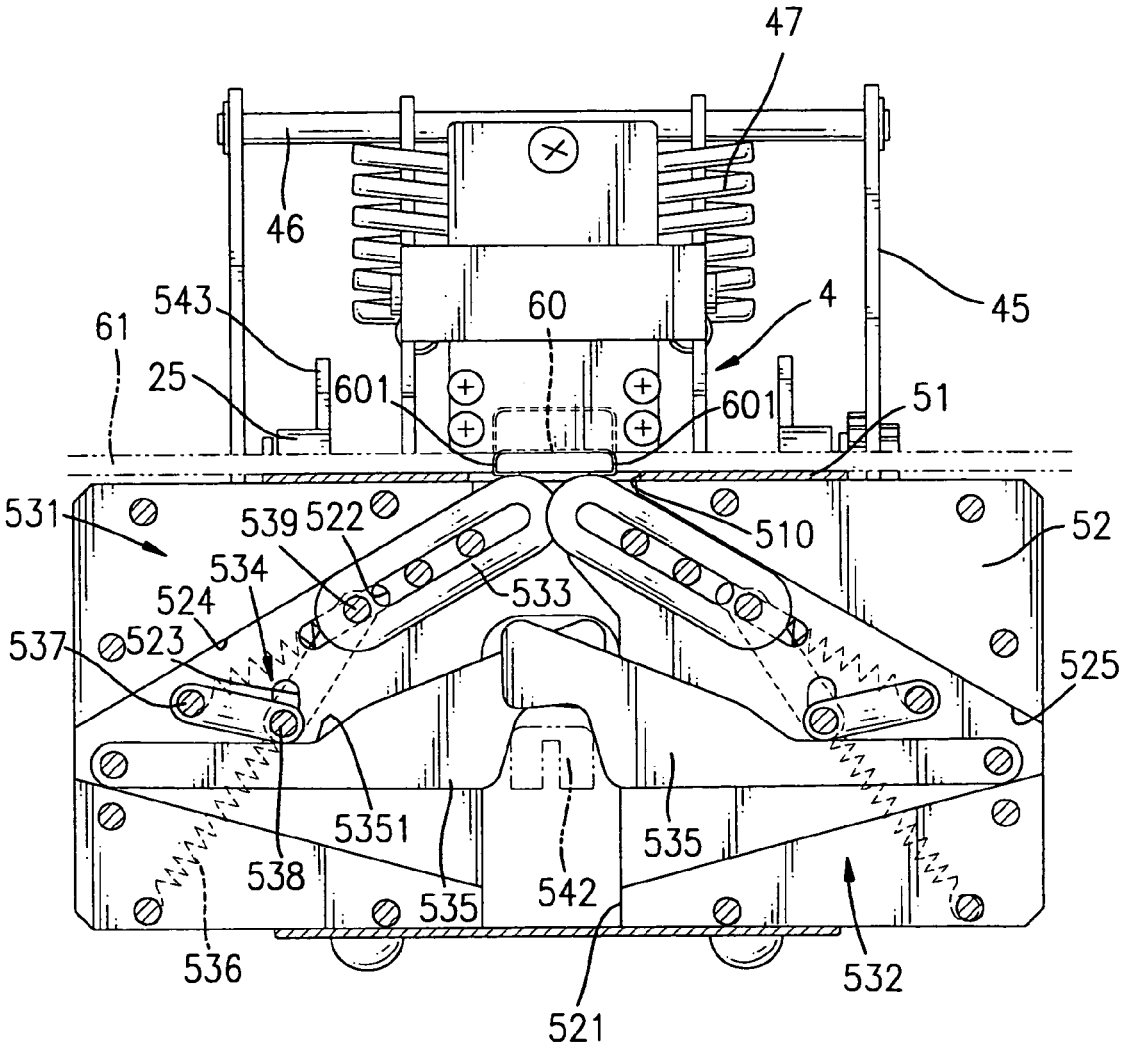
FIG. 5 is an operational front plan view in partial section of the electric stapler in FIG. 4 as two sliding anvils bend the legs of a staple to fasten a stack of objects.

With further reference to FIG. 5, the anvil device (5) is mounted in the frame (1) and is positioned under the driving mechanism (44) to bend the legs (601) of a staple (60) driven through the object (61) by the driving mechanism (44). The anvil device (5) comprises a cover (51), a stationary frame (52), a sliding anvil mechanism (53) and an anvil driving device (54). The cover (51) is mounted on the first and the second wings (11, 12) and has a through hole (510) through which the legs (601) of the driven staple (60) protruding from the bottom of the object (61) extend.

The stationary frame (52) is mounted on the first and the second wings (11, 12) and has an arm slot (521), two elongated sliding holes (522), two curved guiding slots (523), a deep inner recess (524) and a shallow inner recess (525). The arm slot (521) is defined vertically completely through the stationary frame (52) between the first and the second wings (11, 12) and is aligned with the through hole (510) in the cover (51). The deep and the shallow inner recesses (524, 525) are defined alongside the arm slot (521) and correspond to each other. The elongated sliding holes (522) are defined completely through the stationary frame (52) and are positioned symmetrically alongside the arm slot (521). The curved guiding slots (523) are defined completely through the stationary frame (52) and are positioned symmetrically alongside the arm slot (521).

The sliding anvil mechanism (53) comprises a first anvil device (531) and a second anvil device (532). The first and the second anvil devices (53 1, 532) have a similar structure, and each of them comprises a sliding anvil (533), a linkage device (534), a pivot swing arm (535) and two restitution springs (536).

The sliding anvils (533) are slidably mounted respectively in the deep and the shallow inner recesses (524, 525) and will slide toward the through hole (510) in the cover (51) to bend the protruding legs (601) of the staple (60) in the through hole (510). Each recess (524, 525) has an inclined edge with which one of the sliding anvils (533) abuts to make each sliding anvil (533) slide along a respective inclined edge. By holding the sliding anvils (533) respectively in different recesses (524, 525) at different depths, the sliding anvils (533) are kept from colliding with each other when they slide toward the through hole (510).

The linkage device (534) can be a two-bar linkage and has a stationary end (537), a pivot joint (538) and a sliding end (539). The stationary ends (537) are attached pivotally to the stationary frame (52). The pivot joints (538) are held respectively in and slide respectively along the curved guiding slots (523). The sliding ends (539) are held respectively in the elongated holes (522), slide respectively along the associated elongated holes (522) and are pivotally connected respectively to the sliding anvils (533).

The pivot swing arms (535) are mounted respectively in the deep and the shallow inner recesses (524, 525), and each of them has a top edge (5351) and a free end (not numbered). The top edges (5351) are used to push respectively the pivot joints (538) upward along the associated curved guiding slots (523). Therefore, the pivot joints (538) will slide respectively along the top edges (5351) as the pivot swing arms (53) are pivoted upward. The free ends extend across the arm slot (521) and overlap each other.

The restitution springs (536) are mounted on the stationary frame (52) and connect respectively to the pivot joints (538) and the sliding ends (539) to return the linkage devices (534) and the sliding anvils (533).

The anvil driving device (54) is mounted pivotally on the rear shaft (41) and has a fork configuration. The anvil driving device (54) comprises two elongated arms (541) and a driving arm (542). The elongated arms (541) are pivotally mounted on the rear shaft (41) and extend toward the stationary frame (52) to combine together to form the driving arm (542). Each of the elongated arms (541) has an extension (543). The extensions (543) correspond respectively to the rotating arms (25) on the rotating shaft (22) and extend over the rotating shaft (22). The driving arm (542) extends into and is held in the arm slot (521) under overlapped free ends of the two pivot swing arms (535).

Rotation of the drive gear (211) and the driven wheel (23) will pull the staple magazine (42) downward through the connecting arms (45). The downward movement of the staple magazine (42) results in the driving mechanism (44) simultaneously driving one staple (60) out of the staple magazine (44) and into the object (61). The legs (601) of the driven staple (60) penetrate the object (61), protrude from the bottom of the object (61) and extend into and are held in the through hole (510) of the cover (51).

Simultaneously, the rotation of the rotating shaft (22) rotates the rotating arms (25). The rotating arms (25) will raise respectively the extensions (543) upward, which simultaneously pivot the driving arm (542) upward in the arm slot (521) about the rear shaft (41).

Figure 6:
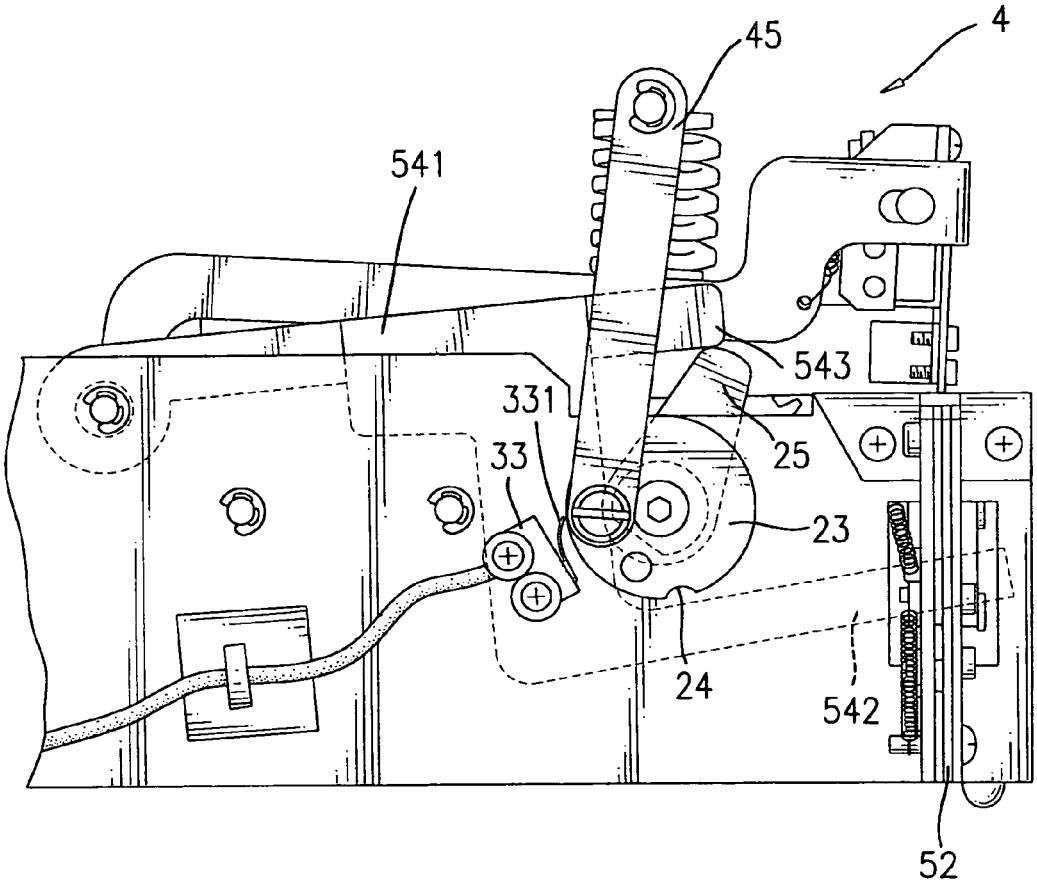
FIG. 6 is an operational side plan view of the electric stapler in FIG. 3 as a driving arm is raised upward to drive the sliding anvils.

With further reference to FIG. 6, the upward driving arm (542) pivots the overlapped pivot swing arms (535) in the arm slot (521) upward. The pivoted pivot swing arms (535) push respectively the pivot joints (538) that slide respectively on the top edges (5351) along the corresponding curved slots (523), which simultaneously slides the connected sliding anvils (533) along the elongated holes (522) toward the through hole (510) in the cover (51). The sliding anvils (533) bend respectively the protruding legs (601) of the staple (60) in the through hole (510) to complete a stapling operation.

The driving-arm (542) will return to its original position when the turning arms (25) disengage respectively the extensions (543). The restitution springs (536) pull the pivot joints (538) and the sliding ends (539) to their original positions to return the driving arm (542).

Consequently, the sliding anvils (533) will efficiently and completely bend the legs (601) of the staple (60) in the through hole (510) to keep a person who holds the stapled pieces of paper from potential injury. The stapler can accommodate for various thicknesses of different objects because the entire protruding legs (601) protruding from the bottom of the object (61) will be completely bent by the sliding anvils (533).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. An electric stapler comprising:

a frame;

a transmission device mounted on the frame;

an actuating device connected to the transmission device;

a clinching mechanism mounted on the frame and having a driving mechanism to drive a staple with two legs to fasten objects together; and an anvil device mounted on the frame to bend the legs of the driven staple and the anvil device comprising a cover having a through hole for receiving the legs of the driven staple;

a stationary frame mounted on the frame and having an arm slot aligned with the through hole in the cover;

a sliding anvil mechanism mounted in the stationary frame and comprising a first anvil device and a second anvil device to bend the legs protruding through the through hole, each of the first and the second anvil devices comprising a sliding anvil to bend a respective one of the legs in the through hole, a linkage device connected to the sliding anvil to slide the connected sliding anvil toward the through hole, a pivot swing arm pivotally mounted in the stationary frame to drive the linkage device and having a free end extending across the arm slot, and multiple restitution springs mounted on the stationary frame and connecting to the linkage device; and an anvil driving device mounted on the frame and having a driving arm extending into the arm slot under the free end of each of pivot swing arms;

whereby the free end of each pivot swing arm in the arm slot is pivoted upward by the driving arm as the driving arm moves upward, each pivoted pivot swing arm pushes the adjacent linkage device to slide the connected sliding anvil toward the through hole.

2. The electric stapler as claimed in claim 1, wherein each of the linkage devices is a two-bar linkage and comprises a stationary end pivotally attached to the stationary frame;

a pivot joint slidably attached to the adjacent pivot swing arm; and a sliding end connected to the connected sliding anvil.

3. The electric stapler as claimed in claim 2, wherein the restitution springs connect respectively to the pivot joints and the sliding ends and are mounted on the stationary frame.

4. The electric stapler as claimed in claim 2, wherein the stationary frame has a deep inner recess and a shallow inner recess, two elongated sliding holes defined completely through the stationary frame alongside the arm slot and two curved guiding slots defined completely through the stationary frame alongside the arm slot;

the first anvil device is mounted in the deep inner recess; and the second anvil device is mounted in the shallow inner recess;

wherein the pivot joints slide respectively along the curved guiding slots and the sliding ends slide respectively in the elongated sliding holes.

5. The electric stapler as claimed in claim 4, wherein the frame comprises a first wing and a second wing parallel to the first wing;

the transmission device comprises a reducer comprising multiple reduction gears that mesh with each other, and the reduction gears comprising a drive gear;

a rotating shaft rotatably having two ends and being mounted in the first and the second wings with its two ends extending respectively out of the first and the second wings;

a driven wheel rotated by the rotating shaft; and a lifter mounted on the rotating shaft and rotated by the rotating shaft to drive the anvil driving device;

wherein the drive gear and the driven wheel are attached respectively to the extended ends of the driving shaft.

6. The electric stapler as claimed in claim 5, wherein the clinching mechanism is mounted on the frame between the first and the second wings and further comprises a rear shaft mounted in the first and the second wings;

a staple magazine pivotally mounted on the rear shaft to hold the staples; and a biasing device comprising two connecting arms connect respectively to the drive gear and the driven wheel and have respectively a top end and a bottom, and the bottom ends pivotally connected eccentrically to the connected driven wheel and the connected drive gear;

a transverse rod attached to the top ends of the connecting arms; and a restitution device mounted between the transverse rod and the staple magazine.

7. The stapler as claimed in claim 6, wherein the restitution device comprises two restitution springs.

8. The stapler as claimed in claim 6, wherein the lifter comprises two rotating arms rotated by the rotating shaft; and the anvil driving device further comprises two elongated arms pivotally mounted on the rear shaft and extending toward the stationary frame to combine together to form the driving arm, each of the elongated arms has an extension over the rotating shaft, and the extensions correspond respectively to the rotating arms rotated by the rotating shaft;

whereby the driving arm is pivoted upward when the rotated rotating arms lift the corresponding extensions.

9. The electric stapler as claimed in claim 8, wherein the actuating device comprises an actuator mounted on the frame and connected to the reducer;

an actuator controller electrically connected to the actuator to control the actuator and having a trigger; and a switch mounted on the second wing and electrically connected to the actuator controller.

10. The electric stapler as claimed in claim 9, wherein the driven wheel has a circular edge and a detent defined in the circular edge; and the switch has a lever that abuts the edge of the driven wheel;

whereby the switch turns the actuator off when the lever slides into the detent on the driven wheel so the driven wheel rotate one revolution of a time.

11. The electric stapler as claimed in claim 10, wherein the actuator is an electric motor.

12. The electric stapler as claimed in claim 1, wherein the frame comprises a first wing and a second wing parallel to the first wing;

the transmission device comprises a reducer comprising multiple reduction gears that mesh with each other, and the reduction gears comprising a drive gear;

a rotating shaft rotatably having two ends and being mounted in the first and the second wings with its two ends extending respectively out of the first and the second wings;

a driven wheel rotated by the rotating shaft; and a lifter mounted on the rotating shaft and rotated by the rotating shaft to drive the anvil driving device;

wherein the drive gear and the driven wheel are attached respectively to the extended ends of the driving shaft.

13. An apparatus to bend legs of a staple for a stapler, and the apparatus comprises a stationary frame;

a cover mounted on the stationary frame and having a through hole for receiving the legs of the driven staple; and a sliding anvil mechanism mounted in the stationary frame and comprising a first anvil device and a second anvil device, each of the first and the second anvil devices comprising a sliding anvil, and each of the sliding anvils being driven toward the through hole and abutting with and sliding along a respective edge in the stationary frame to bend a respective one of the legs in the through hole.

14. The apparatus as claimed in claim 13, wherein the stationary frame has a deep inner recess having an inclined edge and a shallow inner recess having an inclined edge;

the first anvil device is mounted in the deep inner recess and slidably abuts with the inclined edge of the deep inner recess; and the second anvil device is mounted in the shallow inner recess and slidably abuts with the inclined edge of the shallow inner recess.

* * * * *